US010703545B1

(12) United States Patent
Miceli et al.

(10) Patent No.: US 10,703,545 B1
(45) Date of Patent: Jul. 7, 2020

(54) CHILD RESISTANT CLOSURE SYSTEM

(71) Applicant: Altium Healthcare Inc., Atlanta, GA (US)

(72) Inventors: David A. Miceli, Reno, NV (US); Joseph A. Miceli, Spencer, TN (US)

(73) Assignee: Altium Healthcare Inc., Atlanta, GA (US)

( * ) Notice: Subject to any disclaimer, the term of this patent is extended or adjusted under 35 U.S.C. 154(b) by 0 days.

(21) Appl. No.: 16/705,354

(22) Filed: Dec. 6, 2019

Related U.S. Application Data

(63) Continuation-in-part of application No. 16/276,671, filed on Feb. 15, 2019, now Pat. No. 10,507,960, which is a continuation of application No. 14/947,003, filed on Nov. 20, 2015, now Pat. No. 10,252,842.

(60) Provisional application No. 62/082,256, filed on Nov. 20, 2014.

(51) Int. Cl.
*B65D 50/06* (2006.01)
*B65D 1/02* (2006.01)
*B65D 50/04* (2006.01)

(52) U.S. Cl.
CPC ..... *B65D 50/067* (2013.01); *B65D 1/0246* (2013.01); *B65D 50/046* (2013.01); *B65D 2215/02* (2013.01)

(58) Field of Classification Search
CPC .... B65D 50/067; B65D 55/02; B65D 1/0253; B65D 50/046; B65D 50/069
USPC ..... 215/43
See application file for complete search history.

(56) References Cited

U.S. PATENT DOCUMENTS 4,427,124 A * 1/1984 Marshall ..... B65D 50/046 215/209
5,462,182 A * 10/1995 Opresco ..... B65D 50/046 215/216
5,711,442 A * 1/1998 Kusz ..... B65D 50/046 215/209
6,508,313 B1 * 1/2003 Carney ..... B25B 23/1405 173/1
8,881,988 B2 * 11/2014 Miceli ..... B65D 41/04 215/219

* cited by examiner

*Primary Examiner* — Anthony D Stashick
*Assistant Examiner* — Raven Collins
(74) *Attorney, Agent, or Firm* — Luedeka Neely Group, P.C.

(57) ABSTRACT

A closure system includes a container and a closure. The container including a rim extending perpendicular to the side wall, the rim including a locking lug extending from an upper surface of the rim and a break disposed in the rim adjacent to the locking tab, the break operable to form a deflectable locking portion of the rim. The closure including a side wall, a flange extending perpendicular to the side wall, and a locking lug disposed within the flange for engaging the corresponding locking lug of the container. The flange may include a gap portion disposed adjacent to the locking lug for allowing a user to deflect the deflectable locking portion of the container through the gap portion in the flange to disengage the locking lug of the container from the locking lug of the closure.

9 Claims, 13 Drawing Sheets

CHILD RESISTANT CLOSURE SYSTEM

CROSS-REFERENCE TO RELATED APPLICATIONS

This application claims priority as a continuation-in-part to co-pending U.S. application Ser. No. 16/276,671 filed Feb. 15, 2019, which claimed priority as a continuation to U.S. application Ser. No. 14/947,003 filed Nov. 20, 2015, and issued as U.S. Pat. No. 10,252,842 on Apr. 9, 2019, which claimed priority as a non-provisional to U.S. Provisional Application Ser. No. 62/082,256 filed Nov. 20, 2014, each being entitled "Child Resistant Closure System" and the contents of each being incorporated herein in their entireties.

FIELD

This disclosure relates to a child resistant closure system. More particularly, this disclosure relates to a child resistant closure system for pharmaceutical containers requiring interaction from the user with a discrete locking system in order to remove the closure from the container.

BACKGROUND

Many child-resistant closure systems require the user to deflect a tab extending from the container in order to remove the closure when it is installed on the container in a child resistant position. For example, U.S. Pat. No. 5,899,348 describes a closure having a bottom peripheral skirt/flange with a locking lug disposed underneath the skirt, while the container of the '348 Patent has a deflectable release element disposed at an interruption of a neck ring/rim/radial skirt/flange extending from the outer circumference of the container. The release element includes a locking lug axially aligned with the peripheral skirt of the closure when the closure is being installed onto the container such that the locking lug of the closure is operable to engage the locking lug of the container. Engagement of the corresponding locking lugs prevents the closure from being turned in the counter-clockwise direction, and thus prevents the closure from being removed from the container. In order to disengage the locking lugs and remove the closure, the user pushes down on a portion of the deflectable release element that extends out from the skirt/flange of the closure and the neck ring of the container.

Similarly, U.S. Pat. No. 6,508,373 describes a closure having a pair of diametrically opposed internal lugs beneath the closure thread that engage a stop log disposed on a deflectable tab of a container. It is noted that the tab of the container disclosed in the '373 Patent extends tangentially from the container's neck ring in order to provide a portion that extends from the container so that the user can access and deflect the tab when the closure is installed on the container. In order for the tab to deflect, the tab is separated from the external surface of the container and the opposing edge of the neck ring by a tangential slot as best shown in FIG. 7 of the '373 Patent.

One advantage touted by the '373 Patent is that its design can be fabricated by injection blow molding. However, while this may be true, the tangentially spaced tab separated from the container by the tangential slot renders the neck ring asymmetrical, which renders the container of the '373 Patent impossible to manufacture using a more efficient/desirable two-stage injection stretch blow molding method. In this regard, the plastic in a two-stage injection blow molding process is (1) molded into a preform and then ejected from the ejection mold during the injection cycle; and (2) fed after cooling via the container's neck through a reheat stretch blow molding machine during the blowing cycle. Once ejected from the original ejection mold, the "orientation" of the container during the fabrication process is lost. Thus, in order for the container to be properly handled and fed through the stretch blow molding machine during the second stage of the process, the neck of the container must be symmetrical to prevent any mishandling of the preforms by the machine. Similarly, other containers with a deflectable tab extending from the neck ring of the container, such as the container in the '348 Patent described above which is formed by injection molding, result in an assymetrical neck ring that prevents these types of containers from being used in two-stage injection injection stretch blow molding machines. The asymmetrical neck ring also prevents the containers from being used in automated dispensing machines due to the machines' trouble feeding containers with a tab element extending from one side.

Assignee of the present disclosure also describes a reversible closure system having yet another similar child resistant locking system as that of the '348 Patent and '373 Patent in U.S. Pat. Nos. 8,662,331 and 8,881,988, the entire contents of which are both incorporated herein by reference. With respect to the locking system described in the '331 Patent and '988 Patent and referring to FIGS. 1-5 of the present application, the reversible child-resistant closure system 10 includes an injection molded container 12 and a reversible child resistant closure 40.

As shown in FIG. 2, the container 12 generally includes a body 13 and a neck 14. The neck 14 includes a container engaging structure 18 disposed on an exterior of the neck 14, a container opening edge 20 defining a container opening 22, and a bottom edge 25 opposite the container opening edge 20 preferably defined by a neck ring or rim 24. The engaging structure 18 is operable to interact with a corresponding engaging structure 56 on the non-child resistant portion or engaging structure 58 on the child resistant portion of the reversible child resistant closure 40 to secure the closure 40 to the container 12. Disposed adjacent the rim 24 of the neck 14 is a deflectable locking structure 26 preferably disposed at an interruption of space in the rim 24. A locking lug 30 extends from a top surface 28 of the locking structure 26 towards the opening edge 20 of the container 12 for releasably engaging a corresponding locking lug 64 of the reversible child resistant closure 40 when the closure 40 is installed on the container 12 in a child-resistant configuration. For clarification purposes, the locking lug 30 of the container 12 is referred to herein as a locking tab, and the corresponding locking lug 64 of the closure 40 is referred to as a locking projection. In preferred embodiments, the locking tab 30 of container 12 includes a ramp or inclined surface 31 and a locking edge 33.

Referring to FIGS. 3A-3D, the corresponding closure 40 includes a first section 42 having a first edge 44 and a second section 46 having a second edge defined by flange 60. The first section 42 and second section 46 are separated by a solid divider 50 which prevents pharmaceuticals or other materials from exiting the opening 22 of the container 12 whether the one piece closure 40 is used in a child resistant configuration or a non-child resistant configuration. A circumferential sidewall 52 extends around the outer circumference of the closure 40 extending from the first edge 44 of the first section 42 to the flange 60 of the second section 46. The solid divider 50 and sidewall 52 forms a first section cavity 43 extending between the first edge 44 and the divider 50 and a second section cavity 47 extending from the bottom of flange 60 to the divider 50. Thus, the closure 40 provides a one-piece cap that can be lined on both sides as described more particularly in the '988 Patent.

The exterior surface 53 of the sidewall 52 preferably includes a gripping structure such as a plurality of knurls 55 for assisting a user to grip and rotate the closure 40 relative to the container 12. In certain embodiments, and as shown in FIGS. 3A-3D, the knurls 55 are separated into at least two sections with smooth sidewall sections 52 disposed between the sections with knurls 55. The smooth sections 52 are the result of sliding the molded closure 40 from the mold during the ejection process. At least two smooth sidewall sections 52 are typically required. FIGS. 3A-3D depict four smooth sidewall sections 52 for cosmetic purposes.

With continued reference to FIGS. 3A-3D, the first and second section 42, 46 of the closure 40 includes respective engaging structures 56, 58 preferably disposed on the interior surface 54 of sidewall 52 that are operable to interact for rotatable engagement with the complementary engaging structure or structures 18 on the container 12 to secure the closure 40 to the container 12. In this regard, when the closure 40 is applied to the container 12 in the child resistant configuration, engaging structure 58 of the closure 40 interacts with the engaging structure 18 of the container 12. On the other hand, when the closure 40 is inverted and applied to the container in the non-child resistant configuration, engaging structure 56 of the closure 40 interacts with the engaging structure 18 of the container 12. As shown in the Figures, the engaging structures 56 and 58 are preferably solid or segmented threads. However, other suitable engaging structures 56, 58 may be used as long as they are operable to interact with a corresponding engaging structure 18 of the container 12.

As shown best in the inverted view of FIG. 4, the flange 60 of the second section 46 is a peripheral skirt extending radially from the sidewall 52. The locking projection 64 extends radially inward from the inner surface 62 of the flange 60 and is operable to engage the locking tab 30 of the container 12 for preventing the closure 40 from rotating with respect to the container 12 when the closure is installed on the container 12 in the child resistant configuration. In this regard, the locking projection 64 of closure 40 preferably includes a ramp or inclined surface 66 and a locking edge 68. In operation, the closure 40, when applied to the container 12 in the child resistant configuration, is rotated in a closing direction, preferably clockwise, about the neck 14 of container 12 until the locking projection ramp 66 traverses the locking tab ramp 31. In order to remove the closure 40 from the container 12, a user must deflect the locking structure 26 so that the locking projection 64 disengages the locking tab 30. Referring to FIG. 1, a user preferably deflects the locking structure 26 downward to disengage the locking tab 30 of the container 12 from the locking projection 64 of the closure 40.

Thus, in order for the locking tab 30 to releasably engage the corresponding locking projection 64 of the closure 40, the locking structure 26 of this system 10, as well as many other child resistant systems known in the art, is yieldable or deflectable relative to the rim 24 of the container 12. Further, in order to deflect the locking tab 30, the locking structure 26 includes a push down tab 34 extending radially outward with respect to the flange 60 of the closure 40 and rim 24 of the container 12 (when the rim 24 is axially aligned with the flange 60) such that the locking structure is accessible to the user's fingers when the closure 40 is installed in the child resistant configuration. As noted above, the '348 and '373 Patents include similar deflectable tab structures extending from the container neck and the outer circumference of the closure flange in order to disengage their respective locking mechanisms.

While these types of closures systems are generally very effective in preventing a child from opening the closure, it is not impossible for children to open them (hence the name "child resistant"). In particular, a child playing with this type of closure system is likely to be drawn to the tab element extending from the container which, in some instances, may result in the child unintentionally pushing down on the tab element and removing the closure from the container. Also, the child may even figure out how to open the container, such as by watching their parents or even reading instructions displayed on the deflectable tab element, and then be able to do so on their own. What is needed therefore is a more discrete locking system that makes it more difficult for a child to recognize or understand how to open the closure system or otherwise prevents attracting child actions that result in the child unintentionally opening the container.

In another aspect, the ability to more efficiently manufacture a blow molded container incorporating a deflectable tab structure is needed.

SUMMARY

A closure system according to one embodiment of the disclosure includes a container and a closure. The container includes neck portion having a circumferential side wall and a rim extending perpendicular to the side wall, the rim including a locking lug extending from an upper surface of the rim and a break disposed in the rim adjacent to the locking tab, the break operable to form a deflectable locking portion of the rim. The closure is dimensioned and configured to be secured to the neck portion of the container and includes a circumferential side wall, a flange extending perpendicular to the side wall, and a locking lug disposed within the flange for engaging the corresponding locking lug of the container when the closure is installed on the container in a child resistant configuration. The flange is dimensioned and configured to substantially cover the upper surface of the rim of the container and includes a gap portion disposed adjacent to the locking lug for allowing a user to deflect the deflectable locking portion of the container through the gap portion in the flange to disengage the locking lug of the container from the locking lug of the closure.

According to certain embodiments, the gap portion of the flange of the closure is dimensioned and configured to require a foreign object to be inserted through the gap portion to deflect the deflectable locking portion of the container.

According to some embodiments, the rim is circumferentially shaped and the break in the rim is substantially symmetrically aligned with the rim. According to this embodiment, the closure system is preferably manufactured in a stretch blow molding process, and most preferably a two-stage stretch blow molding process. Also, the break in the rim of the container preferably includes a curved slot disposed between the rim and the circumferential side wall of the container.

According to another embodiment of the disclosure, a closure system includes a container having a deflectable container locking mechanism disposed adjacent a rim of the container and a closure dimensioned and configured for being secured to the container. The closure includes a closure locking mechanism operable to engage the container locking mechanism to lock the container in an engaged position and a flange dimensioned and configured to cover the deflectable container locking mechanism of the container when the closure is installed on the container in a child resistant configuration. The flange includes an aperture dimensioned and configured to receive an unlocking tool through the aperture operable to deflect the container locking mechanism to an unengaged position.

According to yet another embodiment of the disclosure, a closure system includes a container and a closure. The container includes a neck portion having a circumferential side wall and a circumferential rim extending perpendicular to the side wall, the rim including a locking lug extending from an upper surface of the rim and a break disposed in the rim adjacent to the locking tab, the break being substantially symmetrically aligned with the rim and including a curved slot disposed between the rim and the circumferential side wall of the container operable to form a deflectable locking portion of the rim. The closure is dimensioned and configured to be secured to the neck portion of the container, and includes a circumferential side wall, a flange extending perpendicular to the side wall, and a locking lug disposed within the flange for engaging the corresponding locking lug of the container when the closure is installed on the container in a child resistant configuration. The deflectable locking portion of the rim is operable to be deflected to disengage the locking lugs of the container and the closure to uninstall the closure from the child resistant configuration.

BRIEF DESCRIPTION OF THE DRAWINGS

Further advantages of the disclosure are apparent by reference to the detailed description when considered in conjunction with the figures, which are not to scale so as to more clearly show the details, wherein like reference numbers indicate like elements throughout the several views, and wherein.

DETAILED DESCRIPTION

Figure 1:
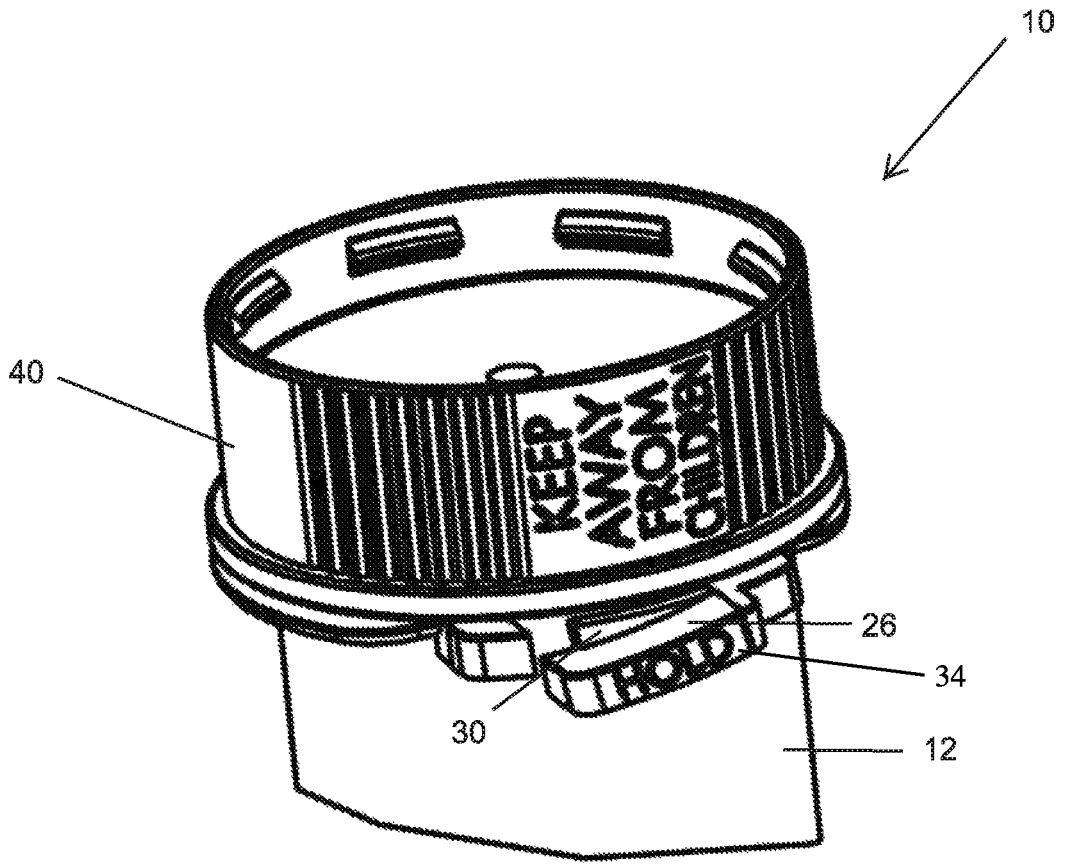
FIG. 1 PRIOR ART
FIG. 1 is a side perspective view of a prior art closure system with a closure installed in a child resistant configuration and a locking structure of a container being deflected downward to remove the closure from the container.
Figure 2:
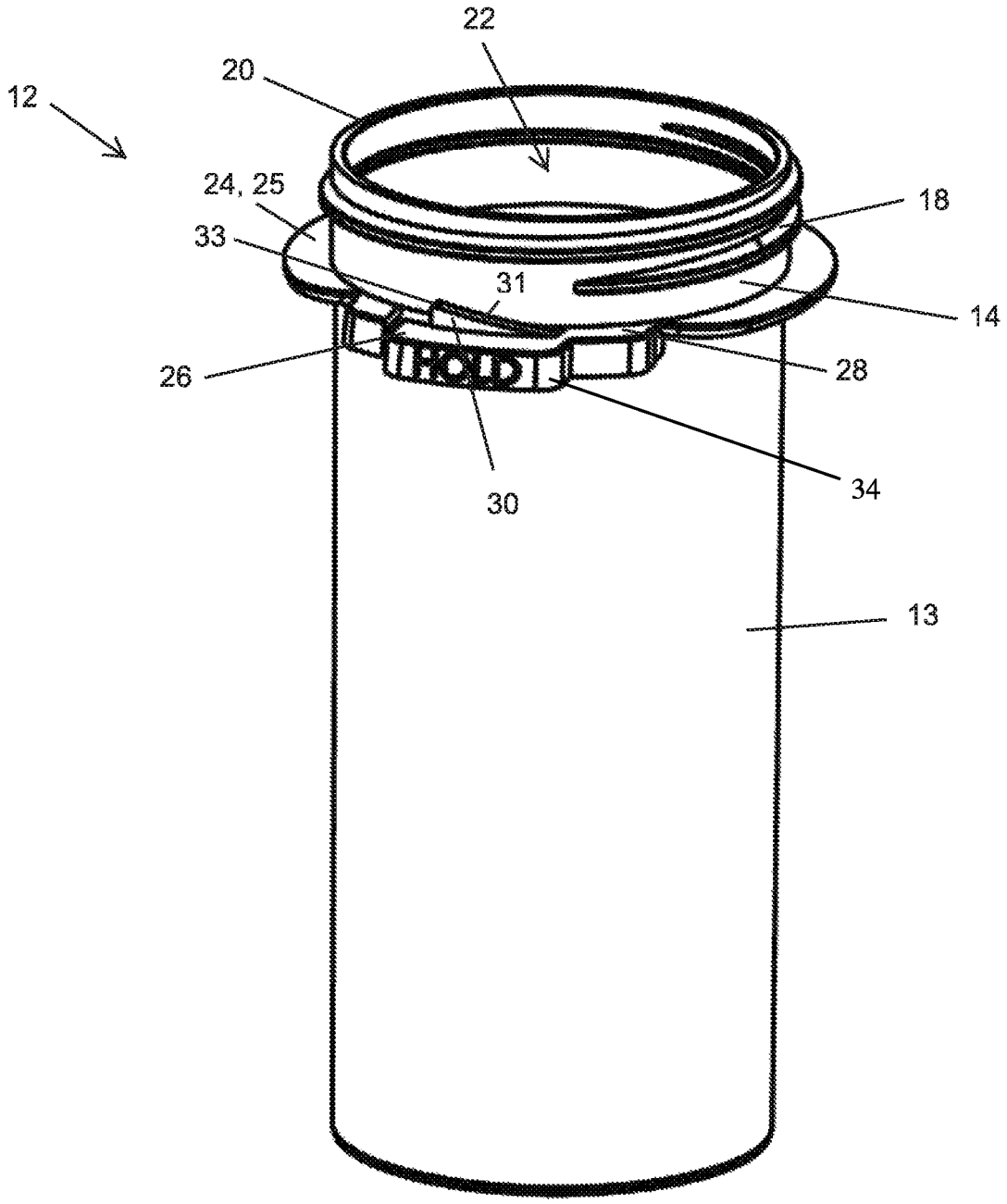
FIG. 2 PRIOR ART
FIG. 2 is a side perspective view of the prior art container of FIG. 1.
Figure 3A:
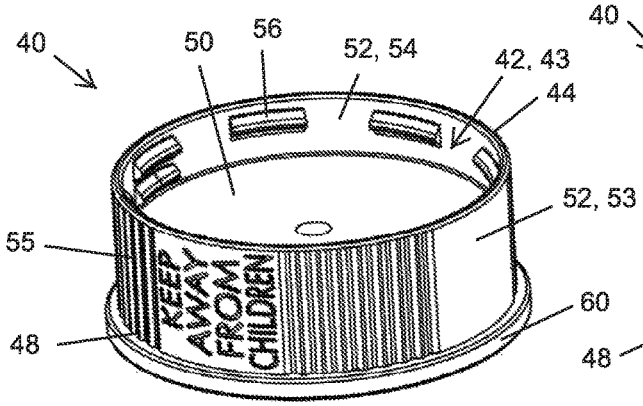
FIG. 3A PRIOR ART
FIGS. 3A-3B are overhead side perspective views of the top section of the prior art closure of FIG. 1.
Figure 3B:
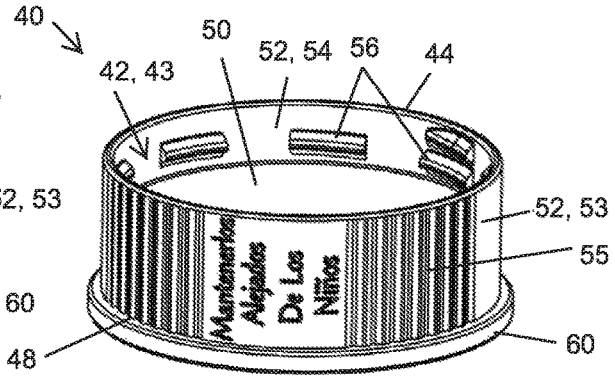
FIG. 3B PRIOR ART
Figure 3C:
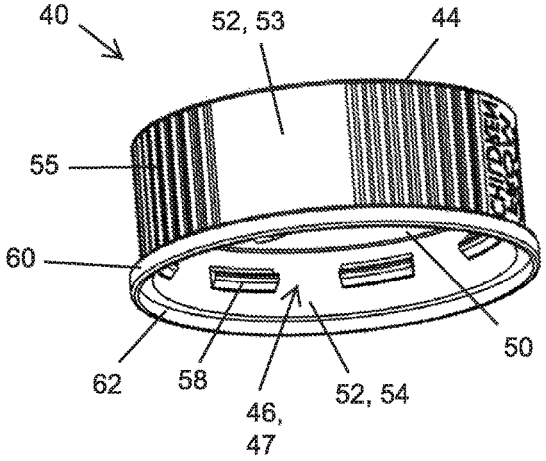
FIG. 3C PRIOR ART
FIGS. 3C-3D are underneath side perspective views of the bottom section of the prior art closure of FIG. 1.
Figure 3D:
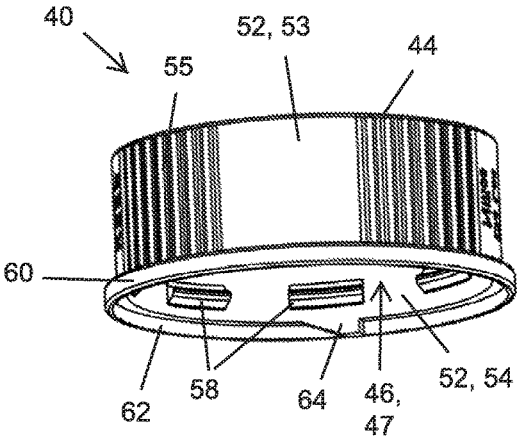
FIG. 3D PRIOR ART
Figure 4:
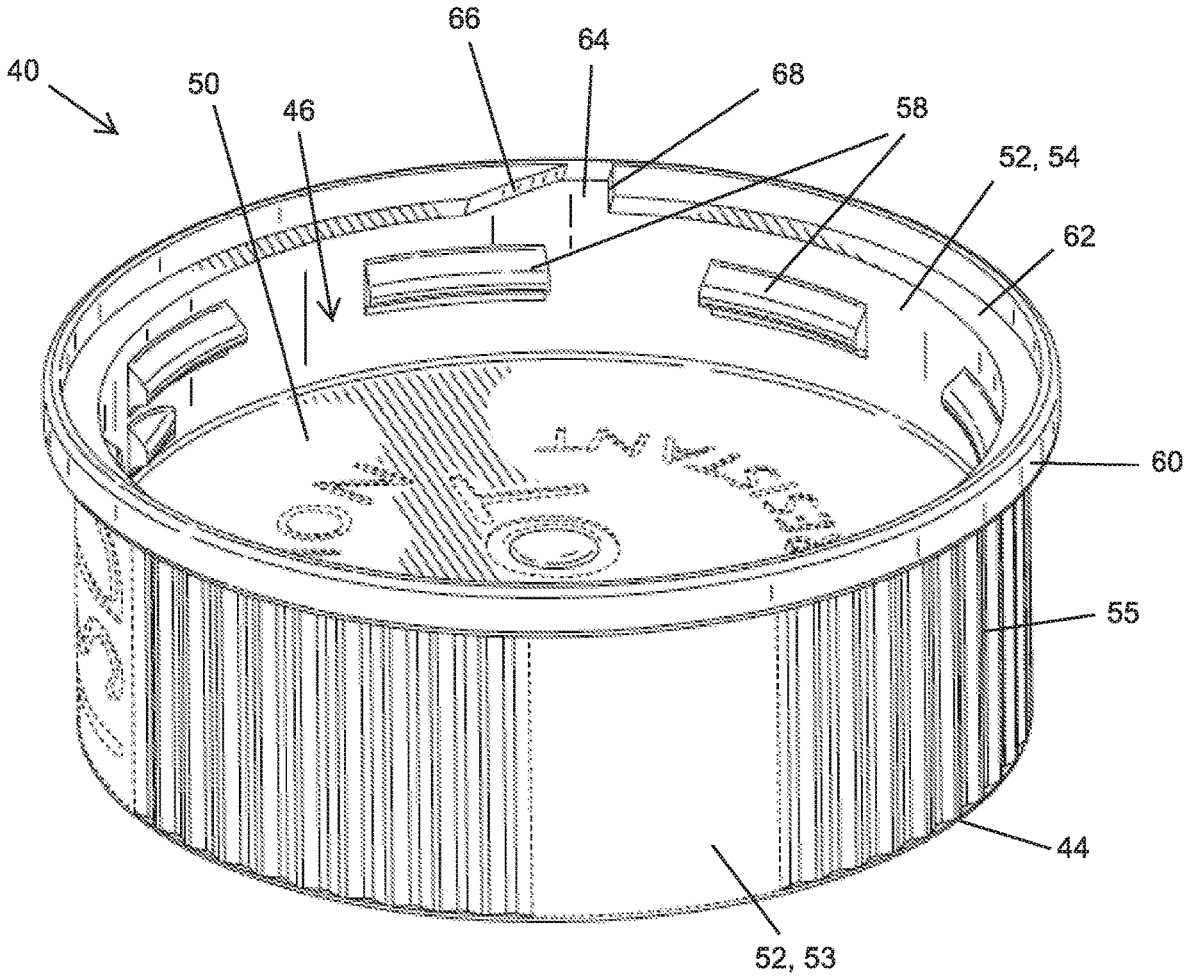
FIG. 4 PRIOR ART
FIG. 4 is an overhead perspective view of the bottom section/child resistant portion of the prior art closure of FIGS. 3A-3D.
Figure 5:
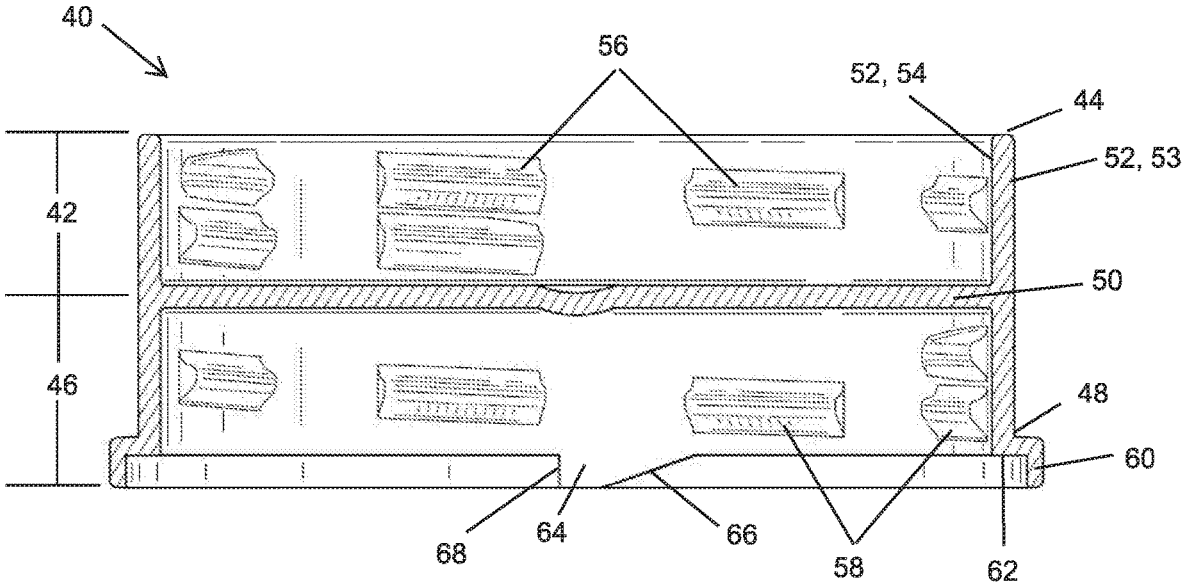
FIG. 5 PRIOR ART
FIG. 5 is a cross sectional view of the closure of FIGS. 3A-3D.

In certain embodiments, the disclosure relates to a child resistant closure system in which an exposed deflectable push down tab element of a locking structure of a container is removed and access is provided to deflect the locking structure through a small gap provided in a peripheral skirt/flange of the closure. The closure system of the present disclosure is primarily directed for use with containers intended to store and dispense pharmaceutical products, and particularly prescription pharmaceuticals. However, the system may also be used with other types of containers in which a child resistant closure is desired.

It should be noted that, while the child resistant closure system 100 described below is similar to the closure system 10 of the '331 and '988 Patents described above and shown in FIGS. 1-5 herein with the primary exception being the manner in which a user is able to access the locking structure 26 of the container 12, the features of this disclosure can be implemented into any other child resistant closure systems utilizing similar deflectable tab elements.

Referring to FIGS. 6-11, closure system 100 includes a container 112 and closure 140 similar to the container 12 and closure 40 substantially as described above with the exception of the locking structure 126 and access provided thereto. In this regard, instead of including a container portion extending radially outward with respect to the rim 24 of the container 12 and flange 60 of the closure 40, the outermost portion of the locking structure 126 of container 112 is preferably radially aligned with the rim 124. In other words, the push down tab 34 of the container 12 described above has been removed such that no portion of the locking structure 126 extends radially outward with respect to the flange 160 of the closure 140. Accordingly, when the closure 140 is installed on the container 112 in a child resistant configuration as shown best in FIG. 10, the manner in which to unlock the closure system 100 is discretely hidden from a user or is otherwise not readily apparent.

Figure 6:
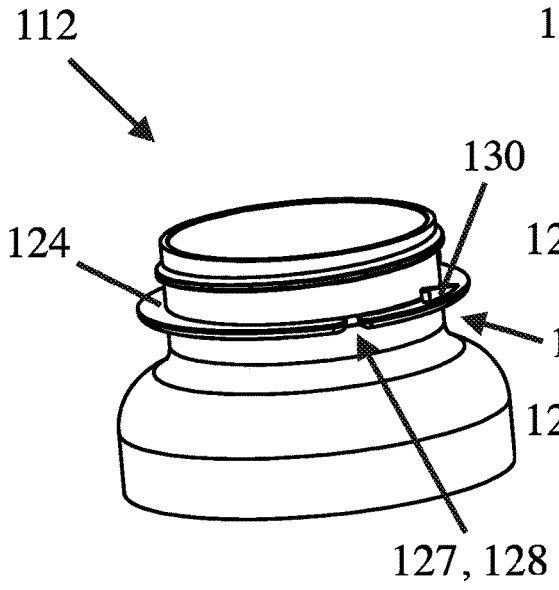
FIG. 6 is a side perspective view of a container according to one embodiment of the disclosure.
Figure 7:
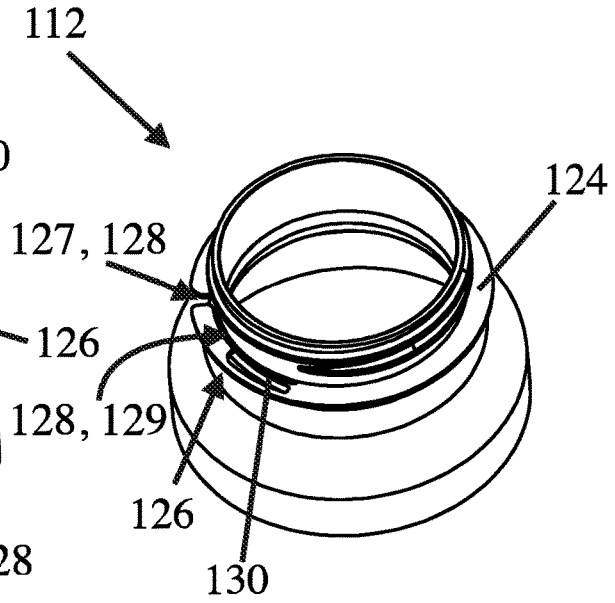
FIG. 7 is an overhead perspective view of the container of FIG. 6.
Figure 8:
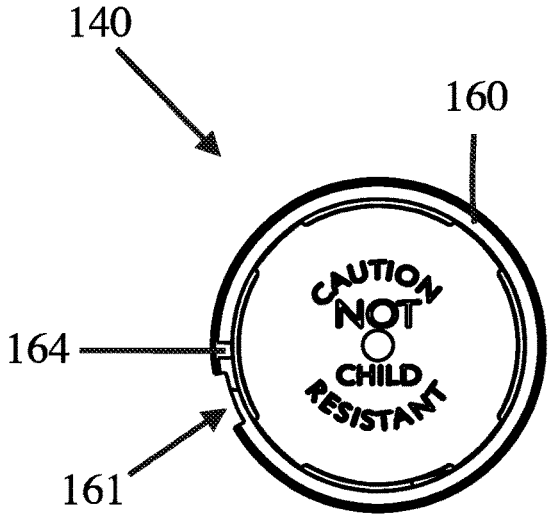
FIG. 8 is a top view of a bottom section/child resistant portion of a closure according to one embodiment of the disclosure.
Figure 9:
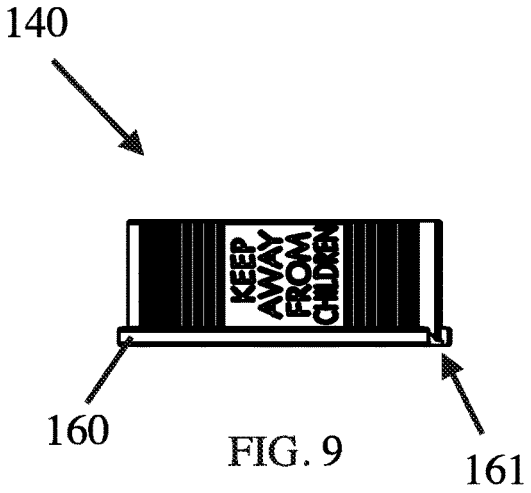
FIG. 9 is a side view of the closure of FIG. 8.
Figure 10:
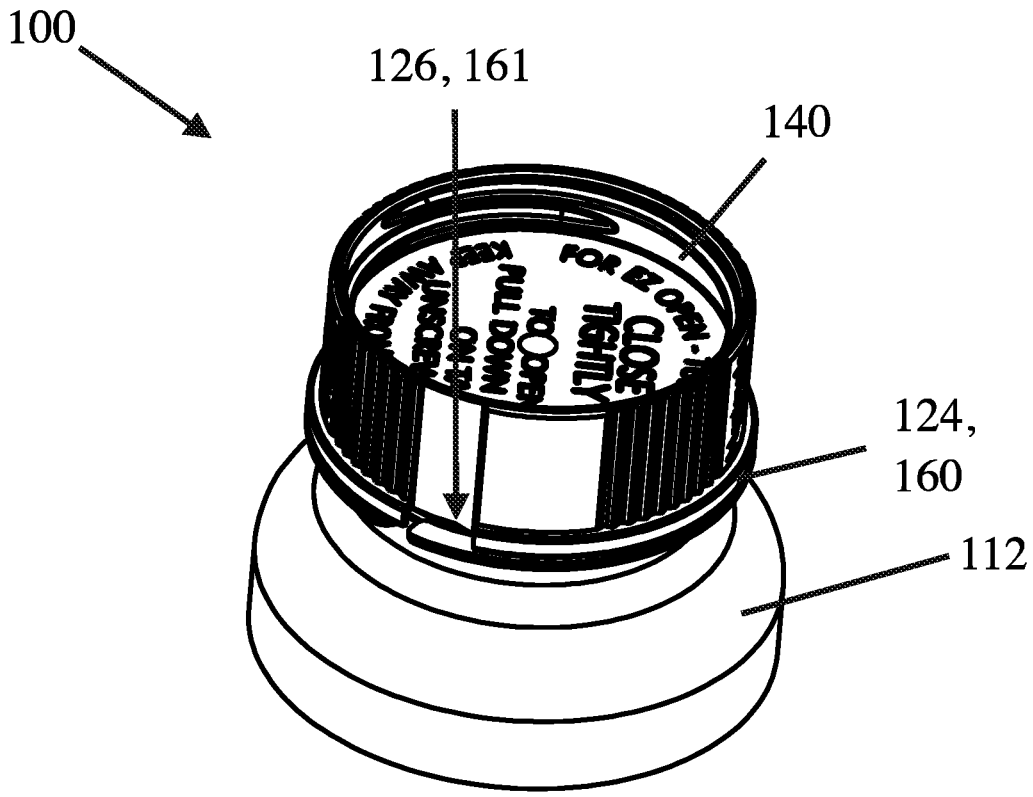
FIG. 10 is an overhead perspective view of the closure of FIGS. 8-9 installed on the container of FIGS. 7-8 in a child resistant configuration.
Figure 11:
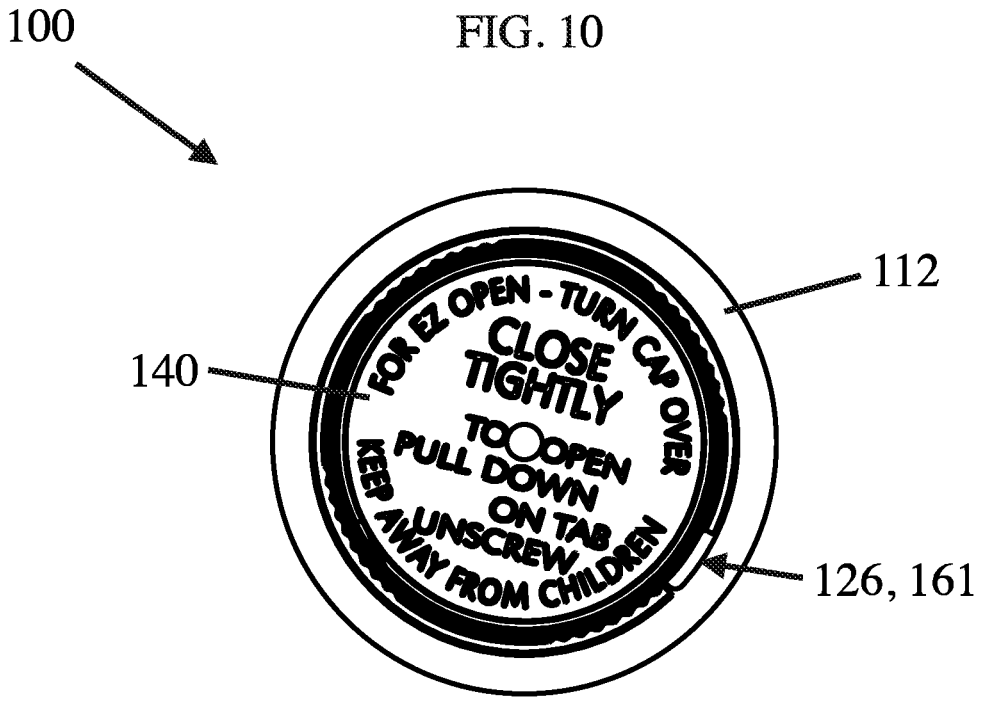
FIG. 11 is a top view of the closure of FIGS. 8-9 installed on the container of FIGS. 7-8 in a child resistant configuration.
Figure 12:
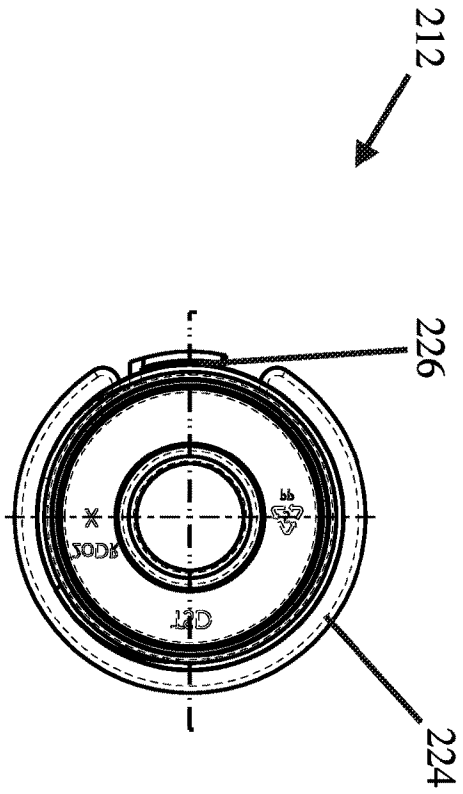
FIG. 12 is a bottom view of a container according to another embodiment of the disclosure.
Figure 13:
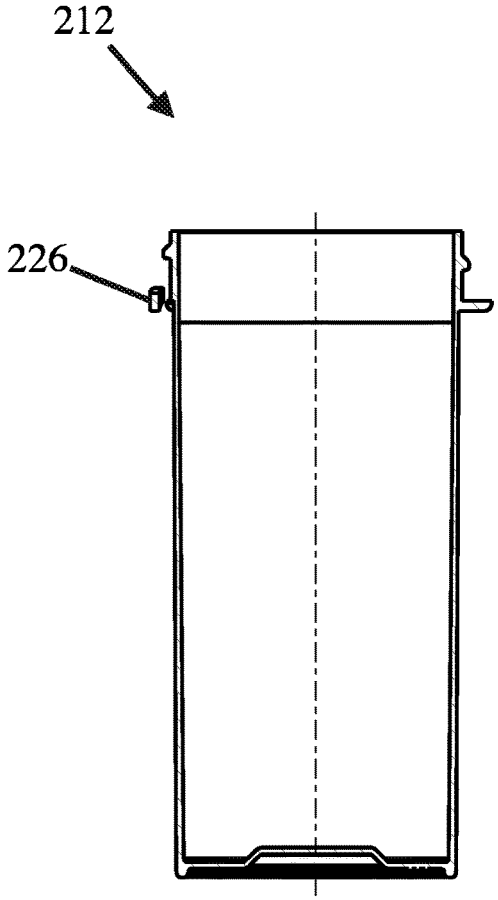
FIG. 13 is a cross-sectional view of the container of FIG. 12.
Figure 14:
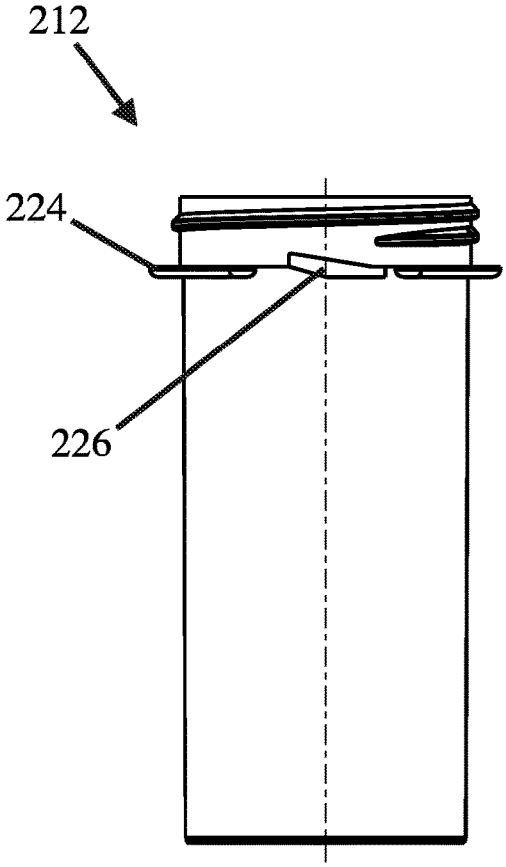
FIG. 14 is a side view of the container of FIG. 12.
Figure 15:
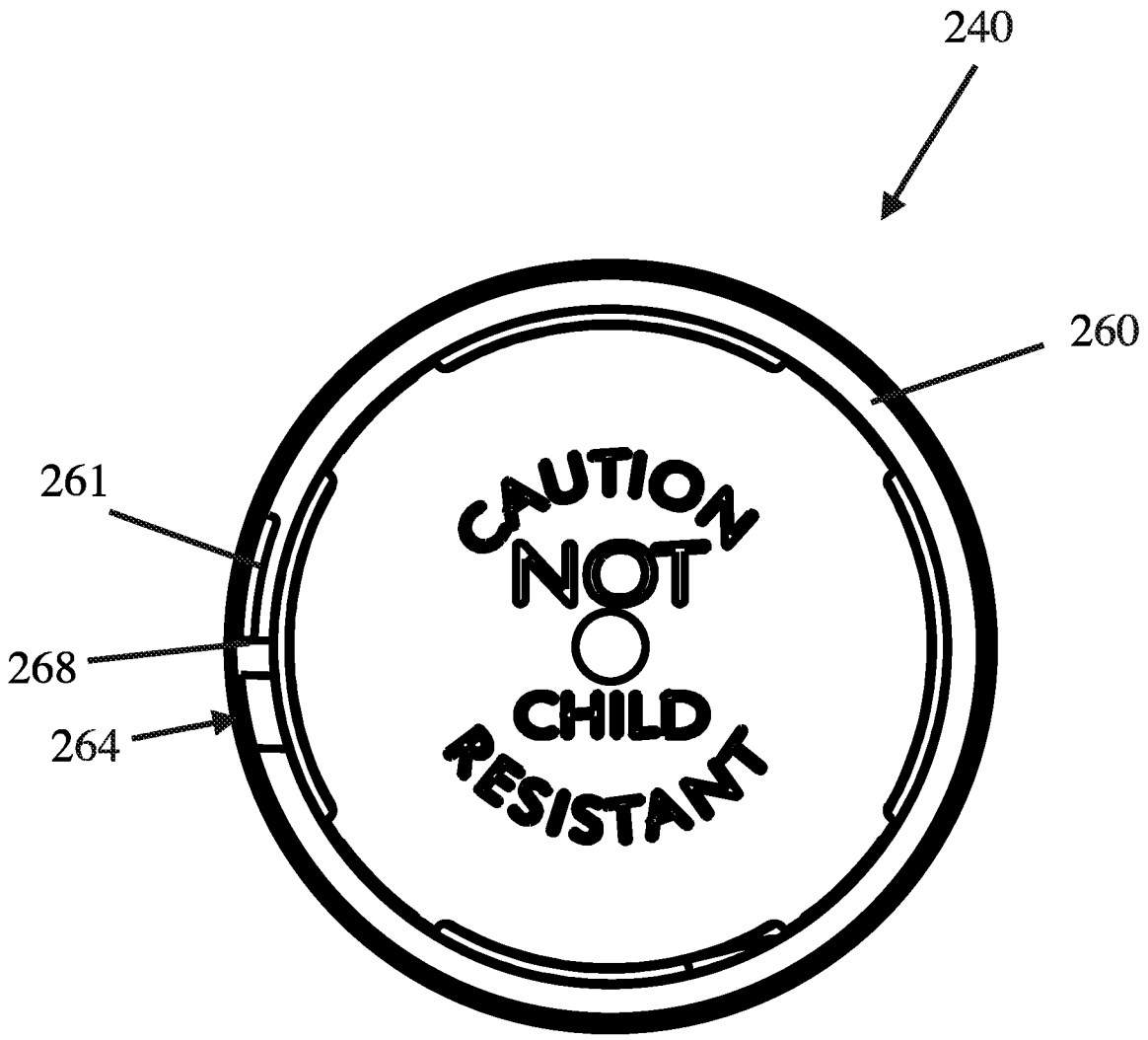
FIG. 15 is a top view of a child resistant portion of a closure according to one embodiment of the disclosure.
Figure 16:
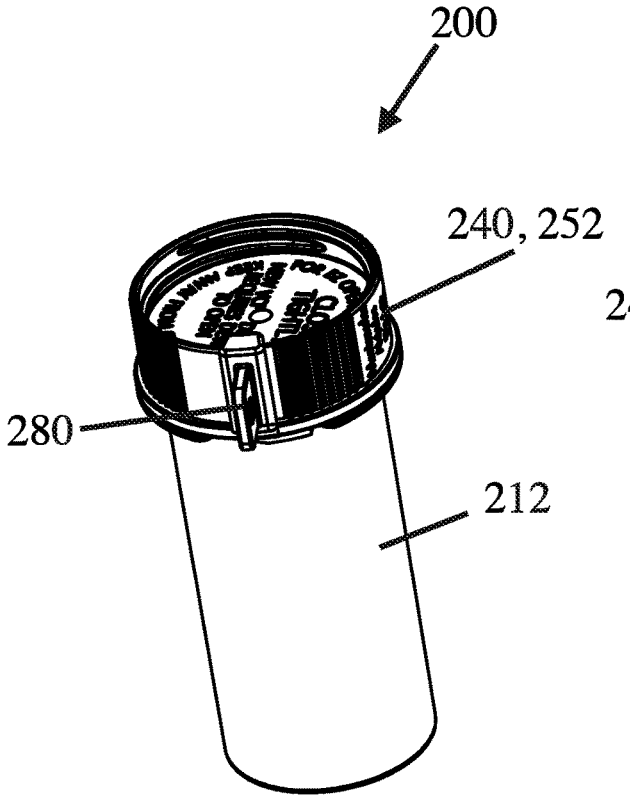
FIG. 16 is a side perspective view of the closure of FIG. 15 installed on the container of FIGS. 12-14 according to one embodiment of the disclosure.
Figure 17:
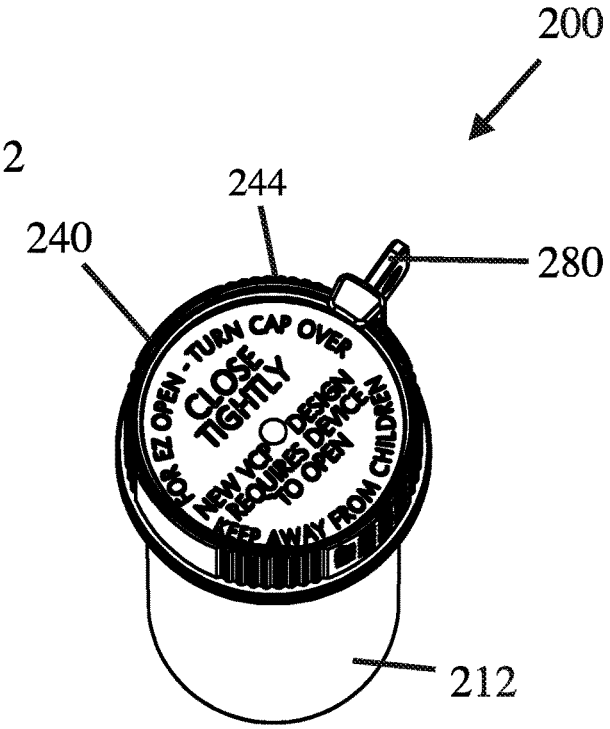
FIG. 17 is an overhead perspective view of the closure system of FIG. 16.
Figure 18:
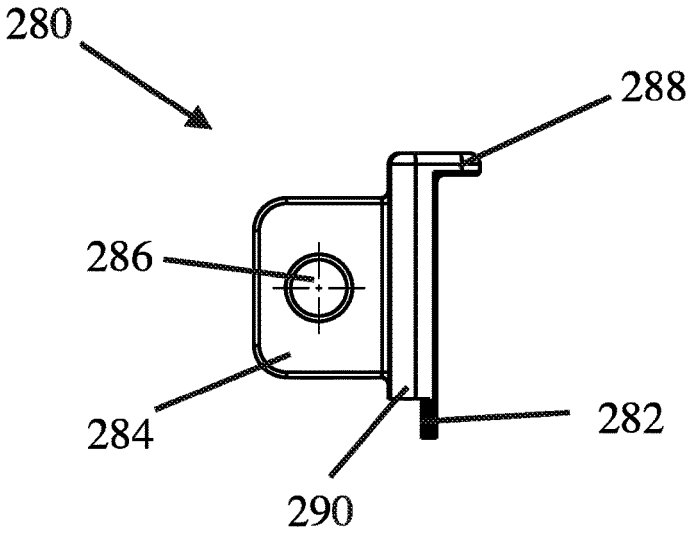
FIG. 18 is a side view of a key for the closure system of FIGS. 16-17 according to one embodiment of the disclosure.
Figure 19:
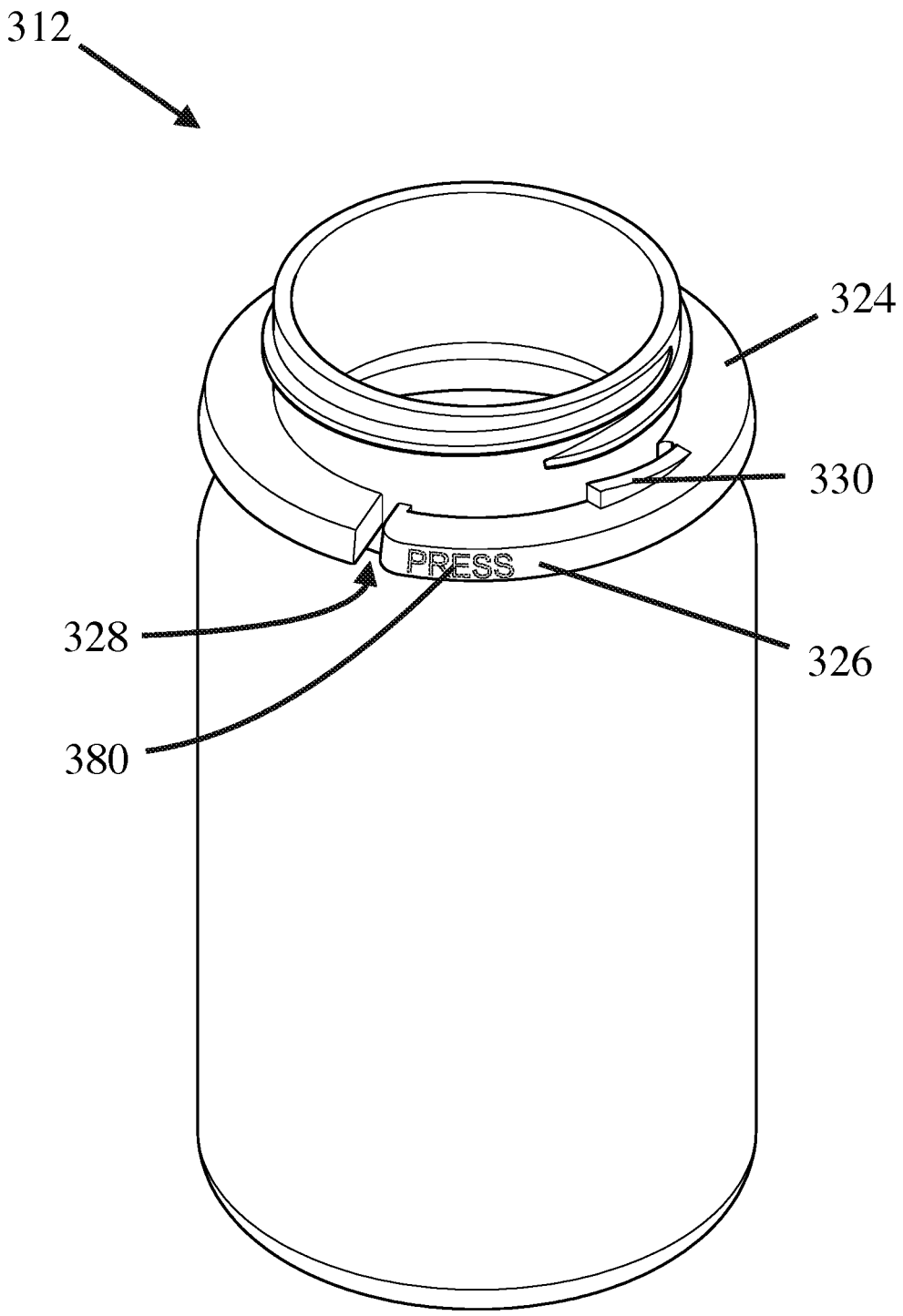
FIG. 19 is an overhead perspective view of a container according to another embodiment of the disclosure.
Figure 20:
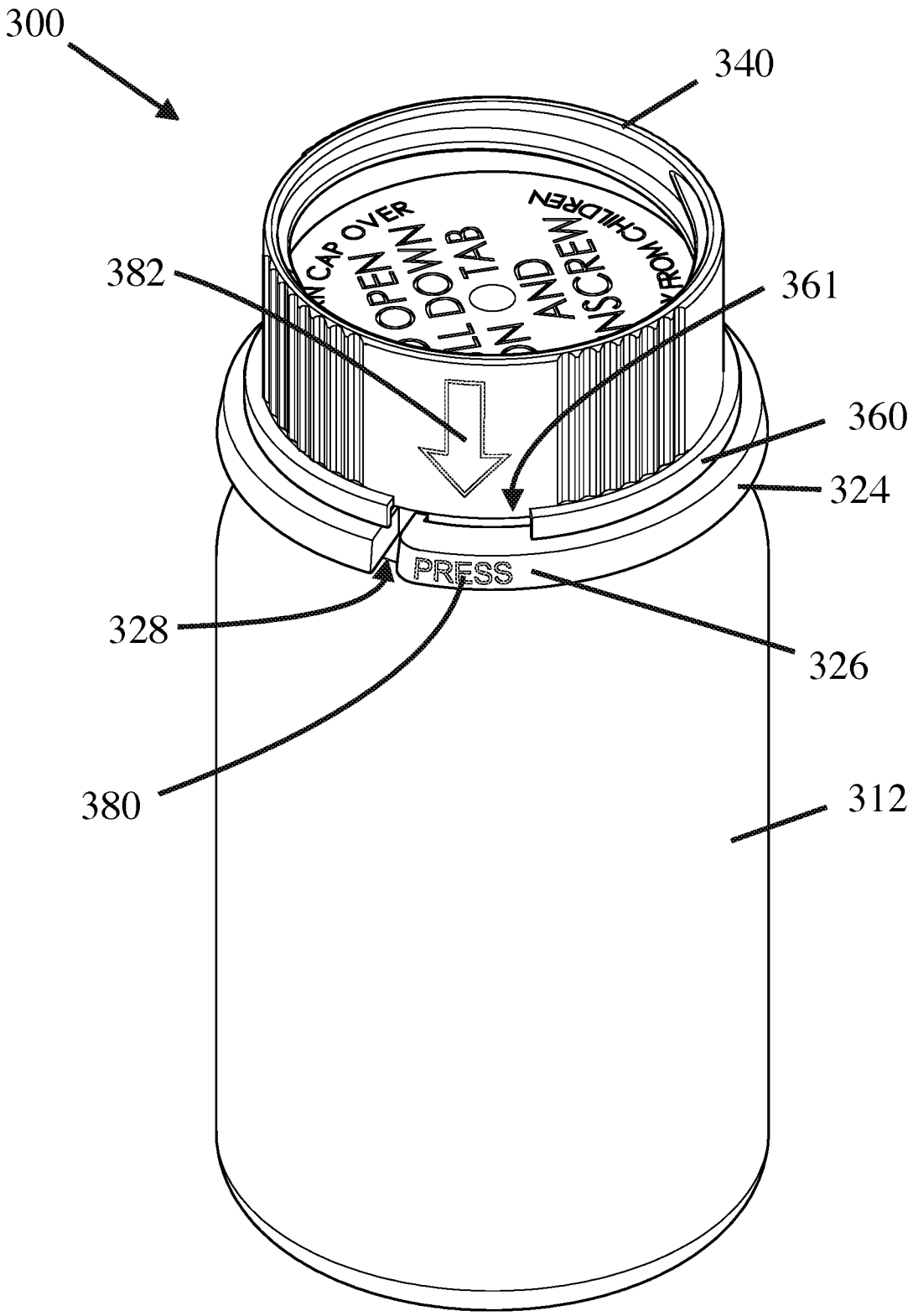
FIG. 20 is an overhead perspective view of the container of FIG. 19 with a closure installed thereon in a child resistant configuration according one embodiment of the disclosure.
Figure 21:
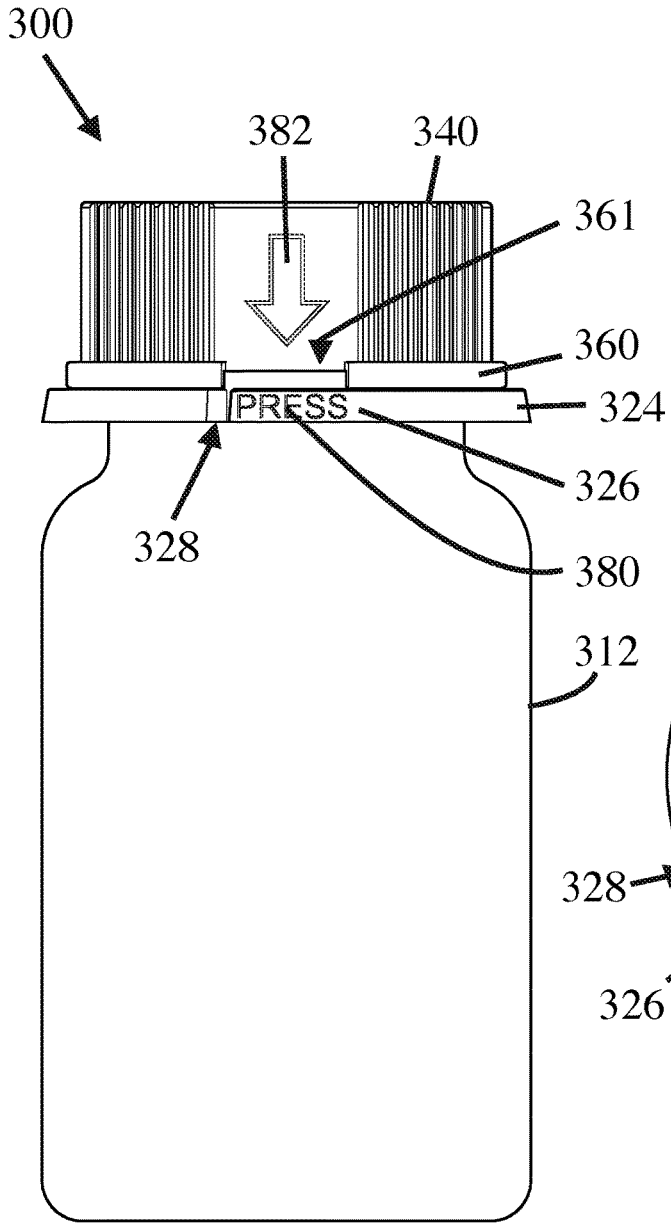
FIG. 21 is a side view of the closure system of FIG. 20.
Figure 22:
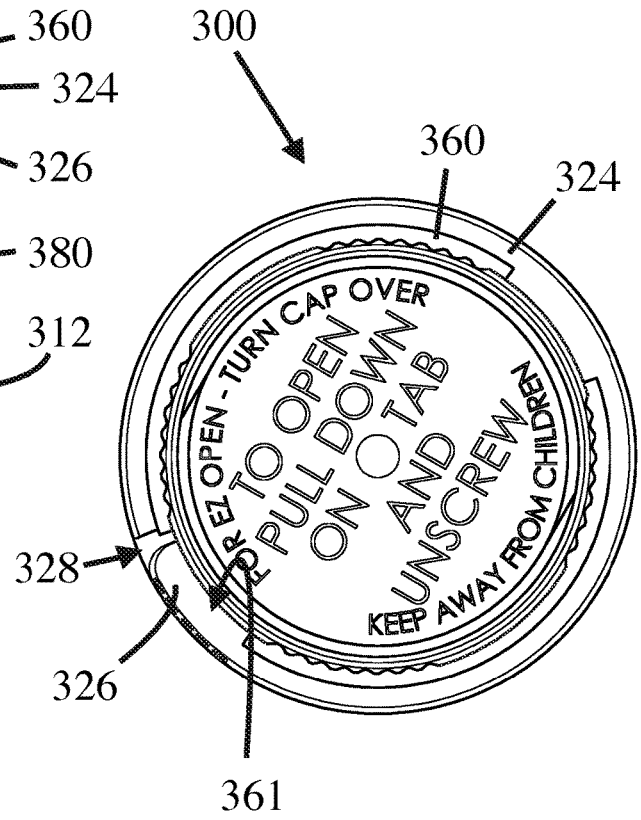
FIG. 22 is a top view of the closure system of FIG. 20.

In preferred embodiments and as shown FIGS. 6-7, the locking structure 126 is simply a locking tab 130 extending from a top surface of a symmetrical rim 124. The rim is referred to as "symmetrical" because the outermost width of the rim 124 in relation to the sidewall of the container 112 is consistent around the entire circumference of the container neck (i.e., there is no radially extending tab protruding from the rim 124 of the container 112). To form the deflecatble portion, a break 128 in the rim 124 is provided adjacent the locking tab 130. Break 128 includes a gap 127 in the rim 124 and a curved slot 129 extending from the gap 127 along the side of the container 112 to at least the tab 130 (i.e., at least a small amount of space is provided between the rim 124 and the side of the container from the gap 127 to the tab 130), which allows for the portion of the rim 124 between the tab 130 and the gap 127 to be deflected slightly downward to disengage the locking tab 130 from the locking projection 164 of the closure 140 when the closure 140 is installed on the container 112 in the child resistant configuration. For purposes of the present application, the break 128 is referred to herein as being substantially symmetrically aligned with the rim 124 due to the rim 124 and break 128 being configured together to provide the substantially symmetrical shape of the rim 124.

Unlike the neck rings described above with respect to the prior art containers having a deflectable tab portion extending from their neck rings, providing container 112 of the present disclosure with a substantially symmetrical rim/neck ring 124 allows the container 112 to be able to be easily and consistently picked up and handled by two stage injection blow mold machines during fabrication or automated dispensing machines during dispensing of medications in the containers 112. Additionally, because there is no longer a projection extending from the rim 124 of the container 112 (i.e., the rim 124 is an entirely symmetrical bead with simply a hinged tab created by the break 128 in the rim 124), it should be understood that container 112 can be manufactured using either a one-stage or the more efficient two-stage injection stretch blow molding fabrication process. In this regard, the curved slot 129 for forming the deflectable portion of rim 124 is able to formed using stretch blow molding techniques because the mold is able to move in both the "X-direction" and one of the "Y-direction" or "Z-direction" in stretch blow molding machines. On the other hand, the curved slot 129 cannot be formed using the injection blow molding method contemplated in the '373 Patent due to the mold in injection blow molding machines only being able to move in the "Y-direction" (the '373 Patent refers to this method as "injection blow molding processes using standard neck ring technology in which the container finish can be formed by straight pull from the neck rings . . . ").

In view of the advantages described above of having a substantially symmetrical rim on containers, alternate embodiments of the present disclosure may include a substantially symmetrical rim that extends out from the container side wall a sufficient distance such that it is not entirely covered by the flange of the closure. In other words, in certain embodiments (such as depicted in the embodiment of FIGS. 19-22 described further below), the present disclosure provides a child resistant closure system in which the rim is symmetrical such that it can be molded in two-stage blow molding fabrication methods and can be easily handled in automated dispensing systems while also providing a somewhat more discernible push down portion if desired by extending the width of the symmetrical rim past the flange of the closure intended to be secured to the container. The added width of the symmetrical rim according to this embodiment also has the advantage of providing more contact surface area for the user to push down on the deflectable locking structure 126 while still avoiding the easily discernible radially extending tab of prior art designs.

Referring to FIGS. 8-11, in embodiments where the rim 124 does not extend out from the flange 160, closure 140 of closure system 100 includes a small gap 161 disposed in its flange 160 for providing access to the locking structure 126 of container 112. It should be understood that the gap 161 may also be provided in embodiments where the rim 124 does extend at least somewhat out from the flange 160 to enhance access to the locking structure 126. In operation of either embodiment, the closure 140 is installed onto the container 112 by rotating the closure 140 until the locking projection 164 of the closure 140 engages the locking tab 130 of the container 112. At this point, the gap 161 of closure 140 is vertically aligned with at least a portion of the deflectable portion of the rim 124 of container 112 disposed between the gap 127 and the locking tab 130. To remove the closure 140 from the container 112, the user inserts the tip of one of their fingers into the gap 161 in the rim 160 of closure 140 and pushes down on the portion of the rim 124 of the container 112 adjacent to the gap 127 in the rim 124 to disengage the locking tab 130 from the locking projection 164 of closure 140.

In alternate embodiments, the gap 161 in the flange 160 of the closure 140 is reduced to a size in which a user cannot access or otherwise push down on the deflectable portion of rim 124 of the container 112 with a user's finger. Instead, the user is required to use a small tool such as a paper clip or the side of a credit card to traverse the gap 161 and deflect the rim 124. In yet a further embodiment, the gap 161 is formed of an aperture of a particular shape such that a specialized key is needed to be inserted into the aperture to push down on the deflectable portion of rim 124.

For example, referring to the alternate embodiment of FIGS. 12-18, closure system 200 includes a container 212 and closure 240 similar to container 12 and closure 40 of container system 10 except the outermost portion of the locking structure 226 of container 212 does not extend out from the container 212 any further than the flange 260 of closure 240 when the closure 240 is installed on the container 212 in the child resistant configuration. Thus, a user is unable to disengage the locking structure 226 of the container 212 from the locking projection 264 of the closure 240 by simply pushing down on the locking structure 226 with one's finger.

Accordingly, in order to remove the closure 240 from the container 212 when the closure 240 is installed in the child resistant configuration, closure 240 includes a small aperture 261 (such as a thin slot as depicted) disposed in flange 260 adjacent to the locking edge 268 of the locking projection 264. In preferred embodiments, the aperture 261 is small enough (0.040 inches or less) such that readily available household items such as coins cannot be inserted into the aperture 261. In most preferred embodiments, aperture 261 is so thin that it is generally not discernible when viewing the closure 240, at least to a child or unless a user knows where to look for it on the closure 240. Accordingly, referring to FIGS. 16-18, disengagement of the locking projection 264 of the closure 240 from the locking structure 226 of the container 212 is permitted only with a separate unlocking tool 280 having a thin key portion 282 that is dimensioned and configured to fit through the aperture 261 and deflect locking structure 226.

In other aspects, the unlocking tool 280 preferably includes a handle portion 284 to assist in gripping the tool 280 and driving the key portion 282 in an appropriate direction (i.e., downward in this embodiment) to deflect the locking structure 226. The handle portion 284 preferably includes a key aperture 286 such that the unlocking tool 280 may be secured to a user's key ring to prevent loss of the unlocking tool 280. The unlocking tool 280 may also include a top lip portion 288 and/or bottom lip portion 290 dimensioned and configured to ensure that the key portion 282 is only inserted into the aperture 261 to a depth sufficient to disengage the corresponding locking structures of the closure 240 and container 212. For example, bottom lip portion 290 may include a thicker portion of tool 280 adjacent to the key portion 282 that does not fit into aperture 261 and contacts the flange 260 once the key portion 282 is inserted a sufficient depth into aperture 261. On the other hand, top lip portion 288 is a portion of tool 280 that extends outward from the main body opposite the handle portion 284 such that the top lip portion 288 contacts the top edge 244 of the closure 240 once the key portion 282 is inserted into aperture 261 to a sufficient depth. Lip portions 288, 290 prevent the user from applying too much pressure to the unlocking tool 280, which in turn prevents the user from breaking the key portion 282 of tool 280 and/or the locking structure 226 of the container 212.

In yet another aspect of the disclosure, the aperture 261 is preferably disposed in the flange 260 directly against the sidewall 252 of closure 240. Thus, in order to locate the aperture 261, the user may position the bottom of key portion 282 against the corner of the sidewall 252 and flange 260 and rotate the closure 240 or unlocking tool 280 until the key portion 282 drops into the aperture 261.

Referring to FIGS. 19-22, another embodiment of the present disclosure provides a closure system 300 generally as described above with respect to FIGS. 6-15. In this regard, the container 312 includes symmetrical rim 324 with a deflectable locking structure 326 formed by a break 328 in the rim 324. Disposed on the upper surface of the rim 324 is a locking tab 330 that is positioned and configured to engage a corresponding locking projection (not shown) in the flange 360 of the closure 340. According to this embodiment, the symmetrical rim 324 of the container 312 extends radially a greater distance than the flange 360 of the closure 340. As described above, this embodiment provides added width to the symmetrical rim 324 to provide more contact surface area for the user to push down on the deflectable locking structure 326 while still avoiding the easily discernible radially extending tab of prior art designs.

With continued reference to the embodiment of FIGS. 19-22, indicia 380 and/or symbols 382 ("indicia" and "symbols" also being referred to collectively herein as "indicia") may be provided on the container 312 and/or the closure 340 to provide operating instructions to users of the system 300 or otherwise direct consumers attention to the gap 361 of the closure flange 360 and/or the deflectable portion 326 of the container rim 324. The indicia 380 and/or symbols 382 are particularly desirable in embodiments or situations where it is believed intended users may have difficulty figuring out the operation of the present system due to the lack of the radially extending tab. In preferred embodiments, and with particular reference to FIG. 20, indicia 380 on the container 312 or closure 340 may be a basic operational term (e.g., PRESS) while the symbol 382 on the closure 340 may be an arrow pointing towards the deflectable portion of the container 312. In preferred embodiments, indicia 380, 382 is disposed in vertical alignment with the gap 361 of the closure flange 360 and/or the deflectable portion 326 of the container rim 324. In most preferred embodiments in which indicia 382 is desired, the closure 340 is molded such that one of the smooth sidewall sections is positioned between knurlment sidewall sections such that a smooth sidewall section is vertically aligned with the gap 361 of the closure flange 360 and/or the deflectable portion 326 of the container rim 324 and the indicia 382 is then provided in the smooth sidewall section.

The foregoing description of preferred embodiments for this disclosure has been presented for purposes of illustration and description. It is not intended to be exhaustive or to limit the disclosure to the precise form disclosed. Obvious modifications or variations are possible in light of the above teachings. The embodiments are chosen and described in an effort to provide the best illustrations of the principles of the disclosure and its practical application, and to thereby enable one of ordinary skill in the art to utilize the disclosure in various embodiments and with various modifications as are suited to the particular use contemplated. All such modifications and variations are within the scope of the disclosure as determined by the appended claims when interpreted in accordance with the breadth to which they are fairly, legally, and equitably entitled.

The invention claimed is:

1. A closure system comprising:

a container having a neck portion, the neck portion including a circumferential side wall and a symmetrical rim extending out from the container side wall, the rim including a locking lug extending from an upper surface of the rim and a break disposed in the rim adjacent to the locking lug, the break being substantially symmetrically aligned with the rim and including a curved slot disposed between the rim and the circumferential side wall of the container neck portion operable to form a deflectable locking portion of the rim; and a closure dimensioned and configured to be secured to the neck portion of the container, the closure including a side wall, a flange extending out in radial symmetry from the closure side wall, and a locking lug disposed within the flange for engaging the corresponding locking lug of the container when the closure is installed on the container in a child resistant configuration, wherein, when the closure is secured to the neck portion of the container, the symmetrical rim of the container extends radially outward a distance further than the flange of the closure, the flange of the closure and the locking of the container and closure are positioned and configured such that the locking lugs are hidden within the flange, and the deflectable locking portion of the rim is operable to be deflected downward to disengage the locking lugs of the container and the closure to uninstall the closure from the child resistant configuration.

2. The closure system of claim 1 wherein the container is manufactured in a two-stage injection stretch blow molding process.

3. The closure system of claim 1 wherein the flange of the closure includes a gap portion disposed adjacent to the locking lug of the closure for enhancing access to the deflectable locking portion of the container rim.

4. The closure system of claim 3 wherein the flange of the closure includes a top exterior surface and a bottom interior surface, the gap portion extending through the top exterior surface and the bottom interior surface of the flange.

5. The closure system of claim 4 wherein the gap portion of the closure is vertically aligned with at least a portion of the deflectable locking portion of the container when the closure is installed on the container in the child resistant configuration.

6. The closure system of claim 1 wherein the closure further includes indicia operable to direct consumers attention to the deflectable locking portion of the container, the indicia being vertically aligned with at least a portion of the deflectable locking portion of the container when the closure is installed on the container in the child resistant configuration.

7. The closure system of claim 6 wherein the flange of the closure includes a gap portion disposed adjacent to the locking lug of the closure for enhancing access to the deflectable locking portion of the container rim and the indicia is vertically aligned with the gap portion of the closure and at least a portion of the deflectable locking portion of the container.

8. The closure system of claim 7 wherein the indicia includes an arrow pointing towards the deflectable locking portion of the container rim when the closure is installed on the container in the child resistant configuration.

9. The closure system of claim 6 wherein:

the side wall of the closure includes a plurality of substantially smooth sections each disposed between two knurlment sections, one of the plurality of substantially smooth sections is vertically aligned with at least a portion of the deflectable locking portion of the container, and the indicia is disposed in the substantially smooth section vertically aligned with at least a portion of the deflectable locking portion of the container.

* * * * *